US007384285B2

(12) United States Patent
Patterson et al.

(10) Patent No.: US 7,384,285 B2
(45) Date of Patent: Jun. 10, 2008

(54) LEVER MATED CONNECTOR ASSEMBLY WITH A LATCHING AND OVERSTRESS MECHANISM

(75) Inventors: Jeremy Christin Patterson, Greensboro, NC (US); Donald Robert Worthington, Pfafftown, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/708,863

(22) Filed: Feb. 21, 2007

(65) Prior Publication Data

US 2007/0197081 A1 Aug. 23, 2007

Related U.S. Application Data

(60) Provisional application No. 60/775,828, filed on Feb. 21, 2006.

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 4,370,013 A 1/1983 Niitsu et al.
5,104,330 A * 4/1992 Yagi et al. ..... 439/157
5,595,492 A * 1/1997 Taguchi ..... 439/157
6,071,153 A 6/2000 Fink et al.
6,361,356 B1 3/2002 Heberlein et al.
6,439,902 B1 * 8/2002 Cole et al. ..... 439/157
6,547,584 B2 4/2003 Myer et al.
6,558,176 B1 5/2003 Martin et al.
6,755,674 B2 * 6/2004 Fujii et al. ..... 439/157
7,137,844 B2 * 11/2006 Flowers et al. ..... 439/372
7,175,451 B2 * 2/2007 Shuey ..... 439/157
2004/0192090 A1 * 9/2004 Flowers et al. ..... 439/157
2006/0040535 A1 * 2/2006 Koshy et al. ..... 439/157

* cited by examiner

*Primary Examiner*—Renee Luebke
*Assistant Examiner*—Harshad C Patel

(57) ABSTRACT

A lever mated connector assembly including a housing configured to mate with a header, a wire guide mounted to the housing having a latch with a retaining surface, a lever having a catch with a retaining surface and being coupled to the housing for rotational movement between an unlocked position and a locked position wherein the catch retaining surface engages the latch retaining surface to inhibit movement of the lever out of the locked position. The wire guide is provided with an overstress mechanism to prevent over extension of the latch to a position where the latch is plastically deformed.

12 Claims, 6 Drawing Sheets

LEVER MATED CONNECTOR ASSEMBLY WITH A LATCHING AND OVERSTRESS MECHANISM

This application claims priority from provisional application No. 60/775,828 filed Feb. 21, 2006, the entirety of which is incorporated herein by reference. This application is related to the following patent application Ser. No. 11/080,736 filed Mar. 15, 2005 now U.S. Pat. No. 7,175,451; and patent application Ser. No. 11/708,966 filed Feb. 21, 2007.

FIELD OF THE INVENTION

The present invention generally relates to electrical connectors, and more particularly to a lever mated connector assembly having a latch for the lever and an overstress mechanism for the latch.

BACKGROUND OF THE INVENTION

In certain applications, electrical connectors must be securely mated to one another to prevent disconnection of the electrical signals routed through the connector conductors. For example, in automotive applications wherein electrical signals are routed to safety equipment such as air bag deployment systems or other systems relating to the operational or safety features of the vehicle, disconnection of the electrical signals as a result of accident, operating conditions such as vibration, etc. may result in undesirable consequences. Thus, some electrical connectors are coupled to connector assemblies that mechanically lock the electrical connectors in mating engagement with one another.

Some conventional connector assemblies include a housing that houses an electrical connector, a wire guide attached to the housing and enclosing the electrical connector, and a lever that couples the housing to a header housing a mating electrical connector. U.S. Pat. No. 6,558,176 is such an example. When in a locked position, the lever prevents disconnection of the housing from the header, which prevents disconnection of the mated electrical connectors. Some levers are further configured to latch into engagement with the wire guide when the lever is in the locked position to ensure that the lever is not unintentionally moved out of the locked position. As this latch may be used multiple times over the course of its life, and as its life is the same as that of the device in which it operates (in the case of automotive use, multiple years) it is desirable to not overstress the latch while disconnecting it.

SUMMARY OF THE INVENTION

The present invention provides a connector assembly, comprising a wire guide having a latch with a retaining surface, the latch having an overstress mechanism to prevent overextending the latch, and a lever having a catch with a retaining surface. The lever is movable between an unlocked position and a locked position wherein the catch retaining surface engages the latch retaining surface to inhibit movement of the lever out of the locked position.

In another aspect of the invention, an electrical connector system is provided having a lever rotatably connected to a wire dress housing, the wire dress housing having a wire shroud against which the lever rests when in a fully mated position. The wire shroud has a latch to lock the lever in the fully engaged position, the latch and the lever rotating in opposite senses when moved into the fully engaged position, and an overstress assembly preventing the latch from overdeflection.

The above mentioned and other features of this invention, and the manner of attaining them, will become more apparent and the invention itself will be better understood by reference to the following description of embodiments of the invention taken in conjunction with the accompanying drawings.

Figure 1:
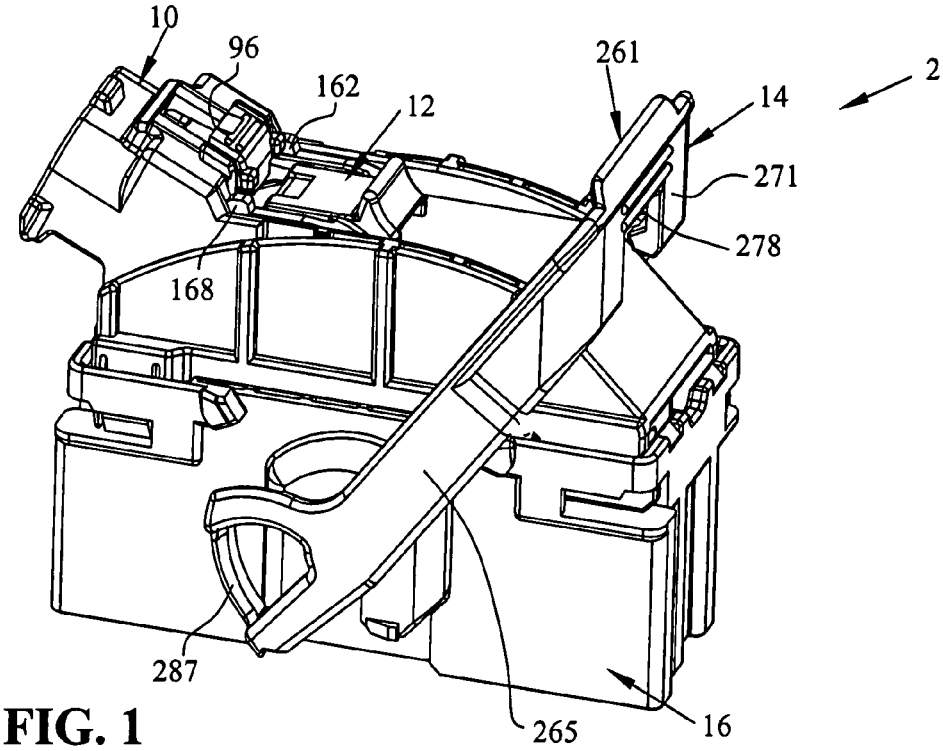
FIG. 1 is a perspective view of one embodiment of a lever mated connector assembly according to the present invention depicting the lever in an unlocked position.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings.

Referring first to FIG. 1, an embodiment of the invention will be described. As shown first in FIG. 1, a lever mated connector assembly is shown at 2 comprised of a wire guide 10, a connector position assurance member (CPA) 12, a rotatable lever 14 and a housing 16. It should be appreciated that, lever 14 is rotatable between the position of FIG. 1, to the position of FIG. 3 where it would be locked in place. CPA 12 acts as stop assuring that the rotatable lever stays in place in the locked position, as more fully described herein. It should also be appreciated that housing 16 would mate with a pin header as is known in the art. This application also incorporates by reference, the disclosure of U.S. Pat. No. 7,175,451 issued Feb. 13, 2007.

Figure 4:
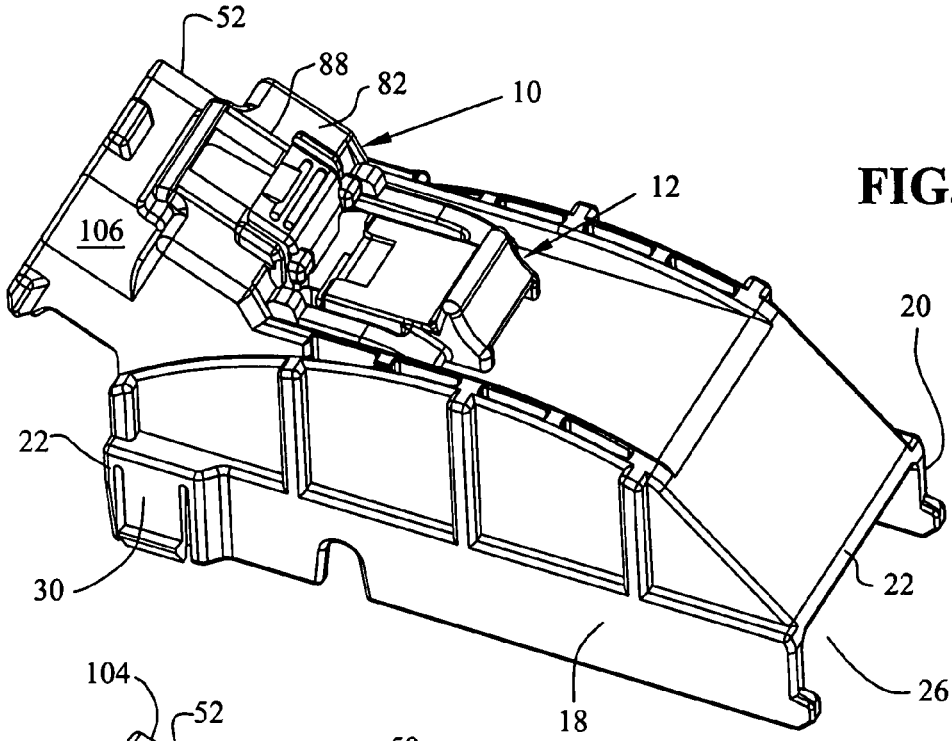
FIG. 4 is a perspective view of the wire guide showing the CPA attached to the wire guide in an unlocked position.
Figure 5:
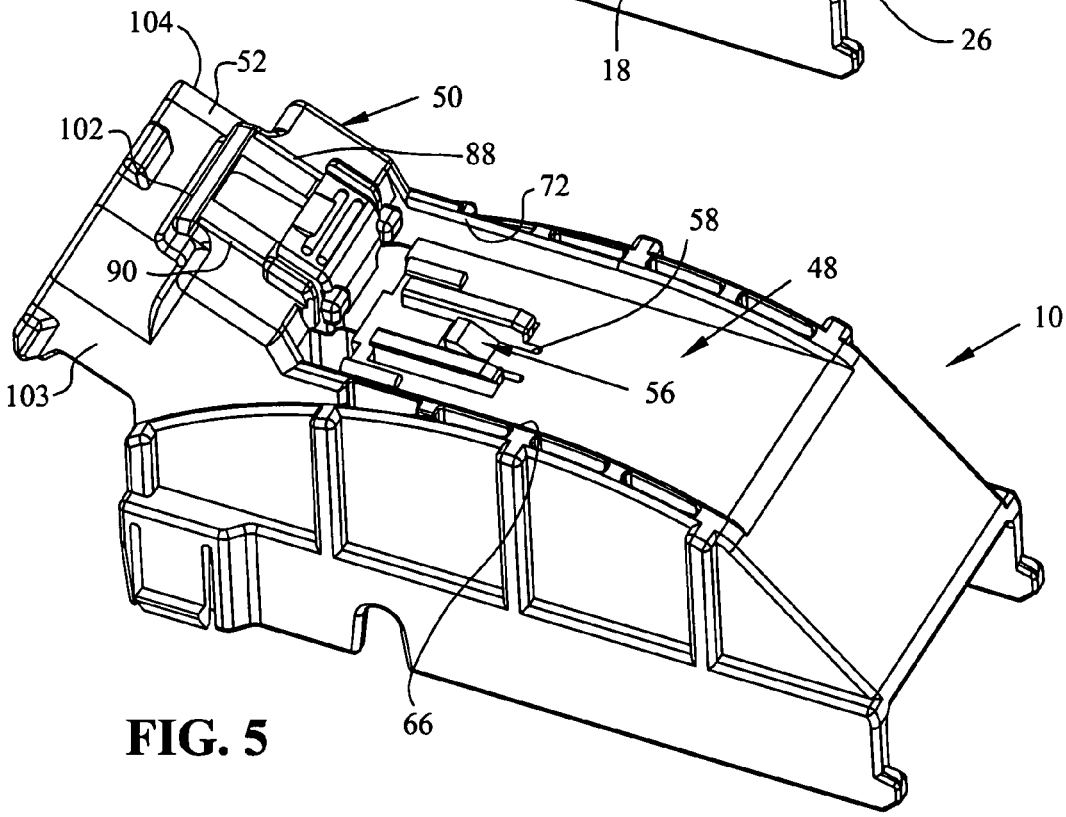
FIG. 5 is a perspective view similar to that of FIG. 3 with the CPA removed.

As shown in FIGS. 4 and 5, wire guide 10 includes sidewalls 18 and 20 and end walls 22, defining an interior space 26. Wire guide 10 includes tabs 30 and 42 (FIG. 8) which retain wire guide 10 to housing 16. As shown in FIG. 5, wire guide 10 defines a CPA receiving portion 48, a lever retaining portion 50 and a wire shroud 52.

Figure 6:
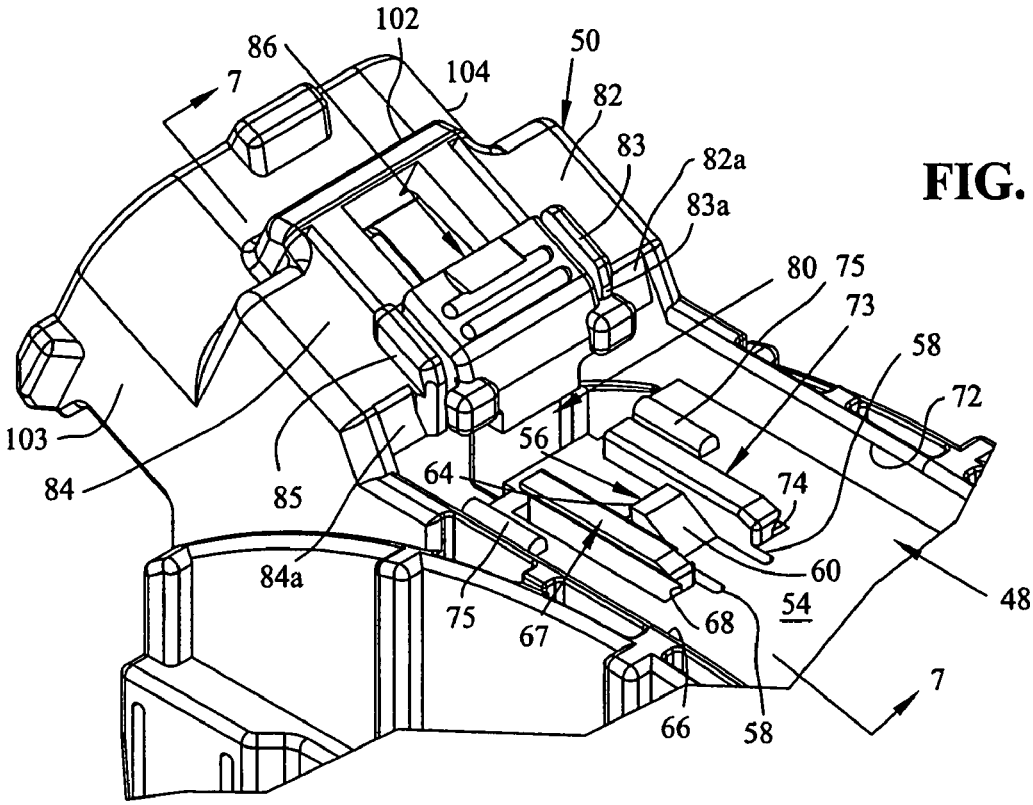
FIG. 6 is an enlarged view of the latch portion of the wire guide of FIGS. 3 and 4.

As best shown in FIG. 6, CPA receiving portion 48 includes a top flat wall 54 with a retaining wedge or latch 56, defined by cutouts 58 molded in the plastic wire guide 10, and surrounding the latch 56. As shown in FIG. 6, retaining wedge 56 includes a camming surface 60 together with a retaining surface 64. CPA receiving portion 48 further includes inner edges 66 and 72, where edges 66, 72 flank dovetail flanges 67, 73. CPA receiving portion is also further described in concurrently filed, commonly owned, application Ser. No. 11/708,966 which claims priority from provisional application 60/775,827, the disclosures of which are incorporated herein by reference.

Figure 7:
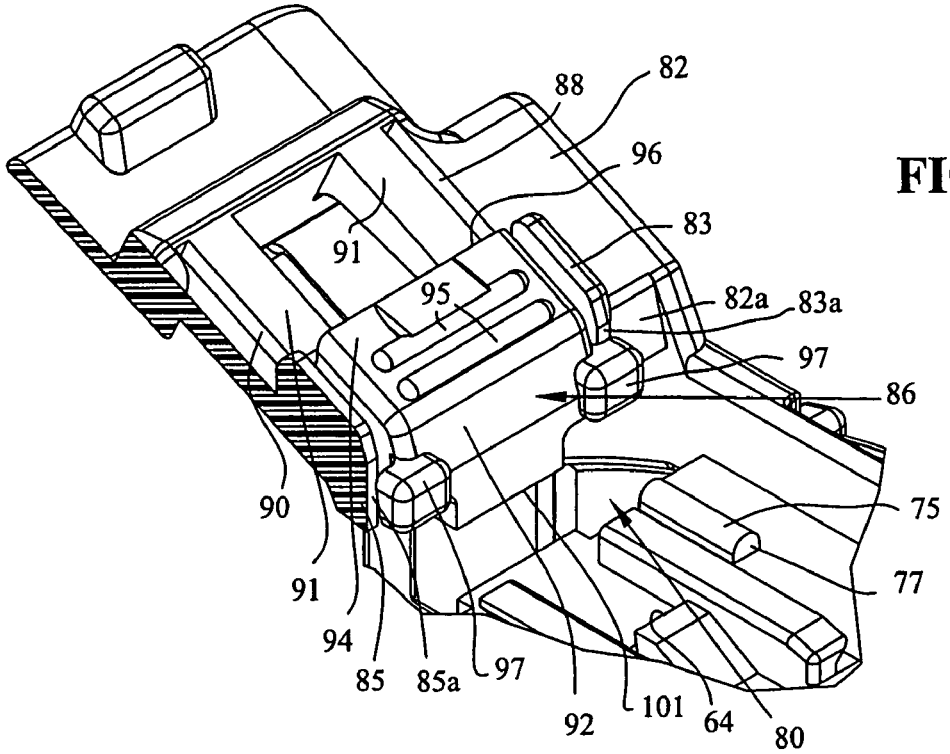
FIG. 7 is a cross sectional view through lines 7-7 of FIG. 6.

With respect still to FIGS. 6 and 7, lever retaining portion 50 intersects with CPA receiving portion 48 to define an opening 80, through which a portion of CPA 12 will be received, as further described herein. Lever retaining portion 50 further includes flats 82 and 84 which define abutting surfaces 82*a*, 84*a*, respectively as best shown in FIG. 6. As best shown in FIGS. 6 and 7, flat 82 has an upstanding wall 83 defining a forwardly directed engaging surface 83*a*, and flat 84 has an upstanding wall 85 defining a forwardly directed engaging surface 85*a* (FIG. 7).

Again with respect to FIGS. 6 and 7, walls 83 and 85 flank cantilever latch 86 which is defined by cutouts 88 and 90 (FIG. 7) through flats 82, 84. Cantilever latch 86 extends from wire guide 10 by way of cantilever arms 91 as shown in FIG. 7. The front edge of cantilever latch 86 includes a cam surface 92 which continues upwardly to define an upper surface 94 having tactile ribs 95.

Cantilever latch 86 includes a retaining surface at 96 for locking with lever 14 as will be described herein. Cantilever latch 86 further includes two overstress wings 97 which extend to a width greater than front edges 83*a*, 85*a*, to define an overstress stop for cantilever latch 86 as will also be further described herein.

Figure 8:
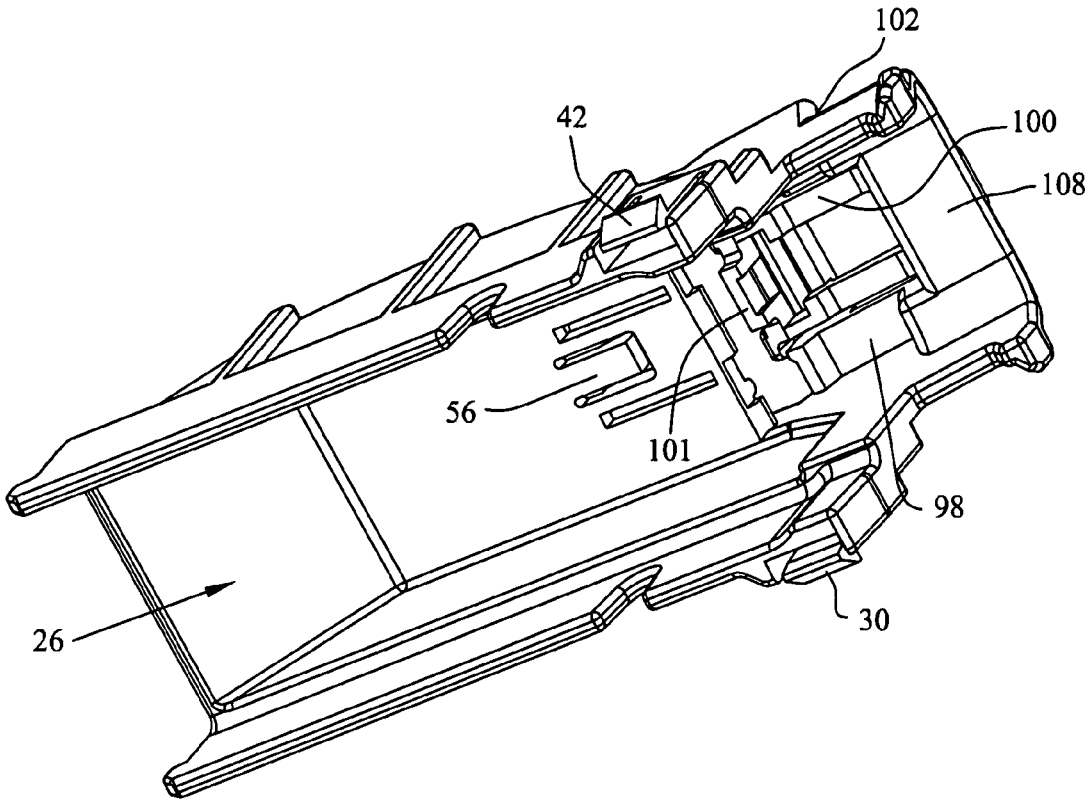
FIG. 8 is a underside perspective view of the wire guide.

With respect now to FIG. 8, recesses 98, 100 are shown which will receive a portion of CPA 12, as further described herein. Finally as shown in FIGS. 4 and 5, wire shroud 52 is defined by distal edge 102, shroud sidewalls 103, 104 together with upper wall 106 (FIG. 4), to define shroud opening 108 (FIG. 8). As shown in both FIGS. 7 and 8, cantilever latch 86 includes a lower edge 101, which will be used as a locking surface as described herein.

Figure 9:
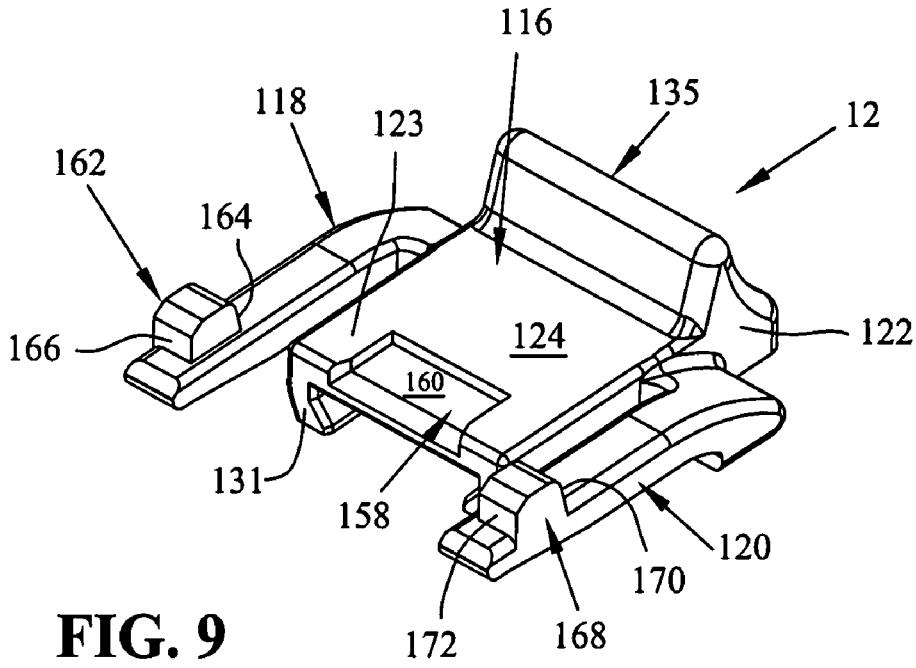
FIG. 9 is a front, top-side perspective view of the CPA shown in FIG. 6.
Figure 10:
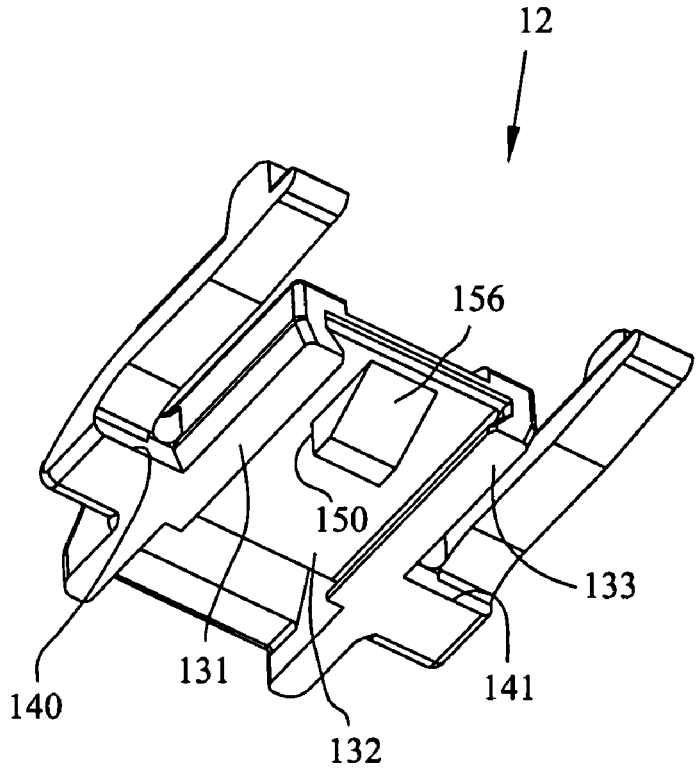
FIG. 10 is a front, underside perspective view of the CPA of FIG. 9.

With reference now to FIGS. 9-10, CPA 12 will be described in greater detail. CPA 12 includes a body 116 having arms 118, 120 flanking body 116. Body 116 includes base portion 122, an extension 123 having an upper wall 124. Rails 131 and 133 extend downwardly from lower wall 132 of body 116. Rails 131 and 133 define dove tail slots as best shown in FIG. 9. It should be appreciated that these cooperate with dove tail flanges 67, 73 as described above.

CPA 12 further includes a push ridge 135 for longitudinal movement of CPA 12. With respect to FIG. 10, CPA 12 includes a retaining wall 150 which cooperates with cam surface 156 in order to lock CPA to wire guide 10 as described herein. With respect to FIG. 9, arm 118 includes a retaining wedge 162, having cam surface 164 and forward surface 166. In a like manner retaining wedge 168 is positioned at a distal end of arm 120, having a cam surface 170 and a forward surface 172.

Figure 2:
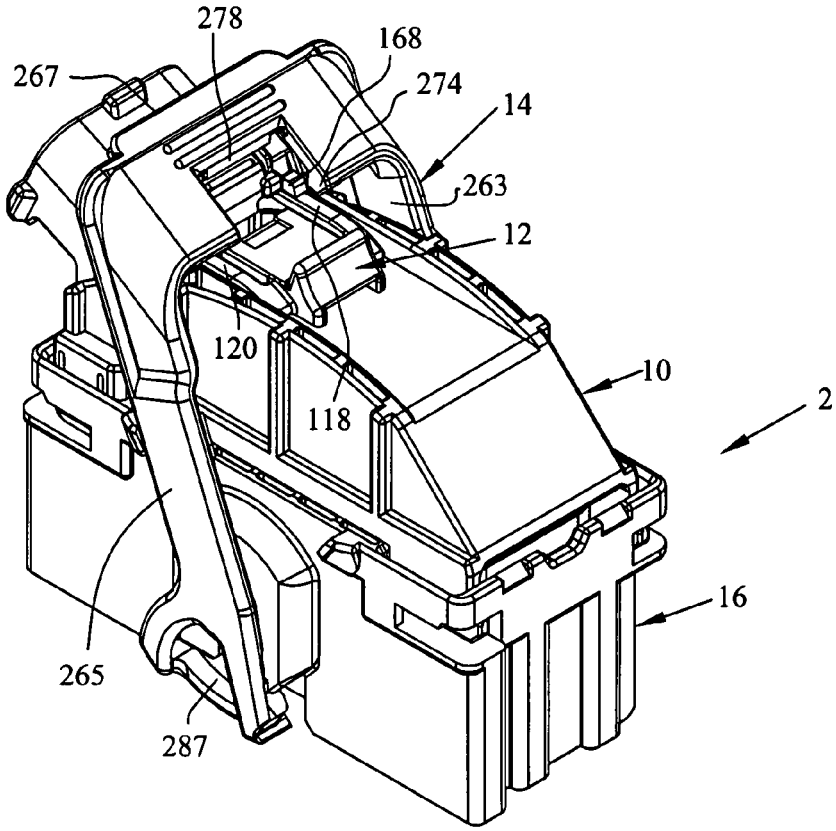
FIG. 2 is a view similar to that of FIG. 1 showing the lever in a position, just prior to the locked position, with the CPA retracted.

With reference again to FIGS. 1 and 2, lever 14 includes handle 261 having support arms 263 and 265, where handle 261 has forward edge 267 and upper surface 271. Cams 274 (FIG. 2) flank arms 118, 120 and are profiled to contact retaining wedges 162, 168, as best shown in FIG. 1, upon rotation. Lever handle 261 further includes catch 278 profiled for engagement against retaining surface 96 of cantilever latch 86 as will also be described herein.

With the items as described above, the assembly and operation of assembly 2 will now be discussed in further detail. With respect first to FIGS. 4, CPA 12 is shown positioned in the CPA receiving portion 48 and retaining wedge 56 would be positioned adjacent to retaining wall 150. Due to the CPA receiving area 48, the CPA 12 is held fixedly mounted to the wire guide 10. The dovetail configuration also provides a low profile mounting arrangement.

When the connector is in the position of FIG. 1, CPA 12 cannot move forwardly, as forward surfaces 166 and 172 (FIG. 9) abut corresponding surfaces 82*a*, 84*a* (FIG. 6). However when the lever 14 is rotated to the position of FIG. 2, cam surfaces 274 of lever 14 (FIG. 2) interact with cam surfaces 164, 170 (FIG. 9) to deflect arms 118, 120 downwardly, to the position of FIG. 2. At this point in time, CPA 12 can be slid forwardly such that recess 158 (FIG. 9) is received under lower edge 101 (FIG. 7) of cantilever latch 86. When in this position, retaining wedges 162 and 168 are received in corresponding recesses 98, 100, holding the CPA 12 in the latched position. When CPA 12 is slid forward, it acts as a stop for the wire guide latch 86, preventing deactivation of the latching feature by preventing rotation of the latch 86.

Figure 3:
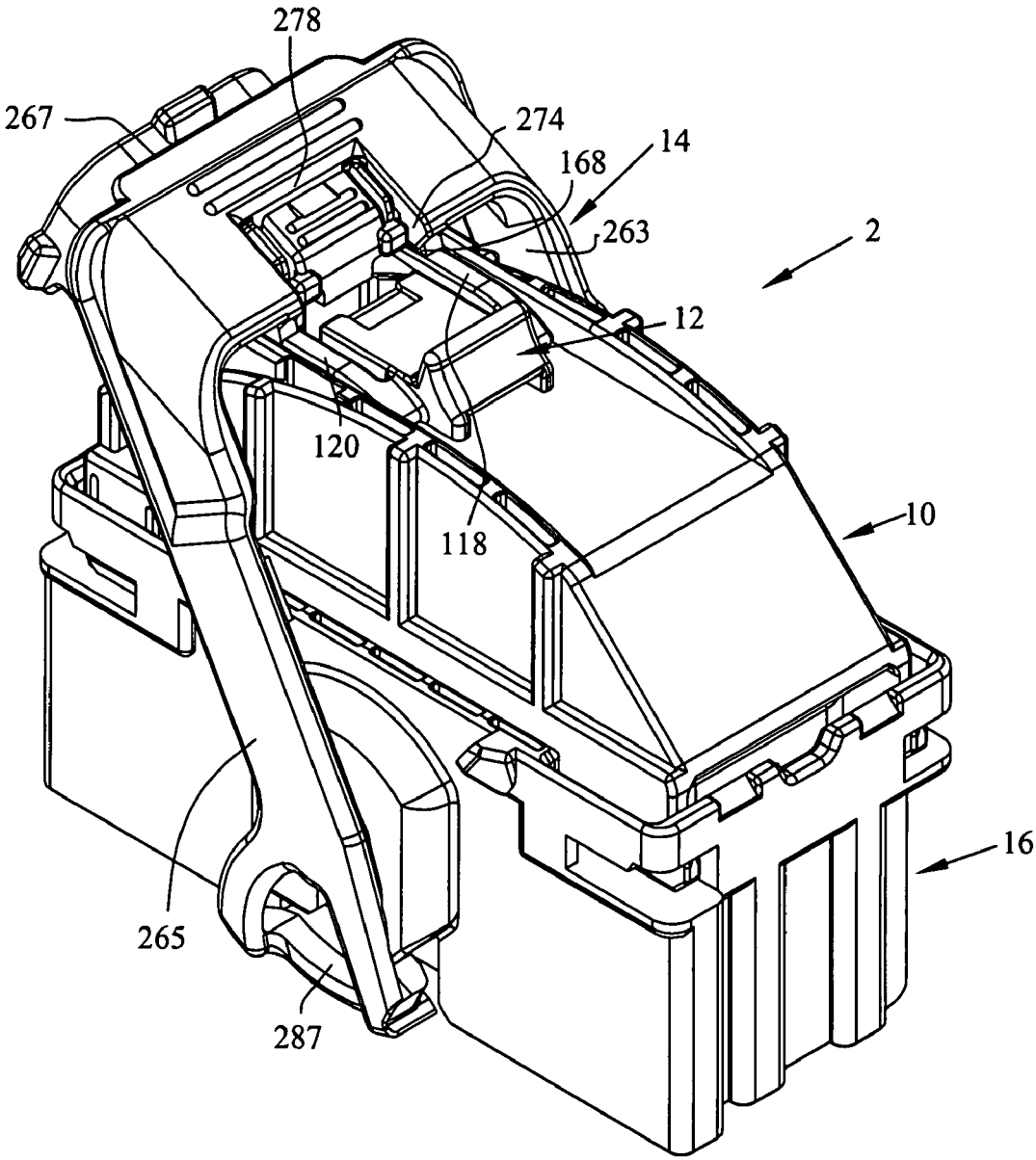
FIG. 3 is a view similar to that of FIG. 1 showing the lever in a position, just prior to the locked position, with the CPA retracted.

To disengage the lever, CPA 12 is moved back to the position of FIG. 3 and the upper surface 94 and tactile ribs 95 are depressed disengaging retaining surface 96 from catch 278. It should be appreciated that overstress wings 97 prevent breaking cantilever latch 86, or overstressing cantilever arms 91 as the overstress wings 97 will engage respective surfaces 83*a*, 85*a* upon a selected deflection amount, to prevent overstress of said latch.

As described, latch 86 is protected along its sides by walls 83, 85. These walls also upstand to the same vertical dimension as the latch, preventing inadvertent actuation of the latch. The overstress wings 97 flank the edges 83*a*, 85*a* (FIG. 7) and will contact them to prevent an overstress situation.

It should also be appreciated that the assembly provides for an ergonomic design, for example a user may place an index finger beneath forward edge 267 of lever 14, while at the same time placing a thumb on top of upper surface 94 and tactile ribs 95, whereby cantilever latch 86 may be depressed by the thumb for release.

What is claimed is:

1. A connector assembly, including:

a wire guide and a latch with a retaining surface;

an overstress mechanism cooperatively provided between the latch and wire guide;

a lever having a catch with a retaining surface, the lever being pivotably movable between an unlocked position and a locked position wherein the catch retaining surface engages the latch retaining surface to inhibit movement of the lever out of the locked position.

2. The connector assembly of claim 1, wherein said latch is cantilevered from said wire guide.

3. The connector assembly of claim 2, wherein said latch moves resiliently within a channel formed in said wire guide.

4. The connector assembly of claim 3, wherein said channel is formed with upstanding walls to protect the latch.

5. The connector assembly of claim 4, wherein said an overstress mechanism is provided on said latch preventing overextension of said latch.

6. The connector assembly of claim 5, wherein said over stress mechanism is comprised of wings which overlap said walls and engage said walls, upon a selected deflection amount to prevent overstress of said latch.

7. An electrical connector system comprising a lever rotatably connected to a wire guide, said wire guide having a wire shroud against which said lever rests when in a fully mated position, and said wire shroud having a latch to lock said lever in said fully mated position, said latch and said lever rotating in opposite senses when moved into said fully mated position, and an overstress mechanism preventing said latch from over-deflection.

8. The electrical connector of claim 7, wherein said latch is cantilevered from said wire shroud.

9. The electrical connector of claim 8, wherein said latch moves resiliently within a channel formed in said wire shroud.

10. The electrical connector of claim 9, wherein said channel is formed with upstanding walls to protect the latch.

11. The electrical connector of claim 7, wherein said latch has said overstress mechanism provided thereon, preventing overextension of said latch.

12. The electrical connector of claim 11, wherein said over stress mechanism is comprised of wings which overlap said walls and engage said walls, upon a selected deflection amount to prevent overstress of said latch.

* * * * *